US005887529A

United States Patent [19]

John et al.

[11] Patent Number: 5,887,529

[45] **Date of Patent: *Mar. 30, 1999**

[54] MODULAR PALLET WITH INTERLOCKING INSERTS

[75] Inventors: Michael John, Boca Raton; Robert V. Daigle, Pompano Beach, both of Fla.

[73] Assignee: Plastic Pallet Production Inc., Dallas, Tex.

[ * ] Notice: The term of this patent shall not extend beyond the expiration date of Pat. No. 5,794,543.

[21] Appl. No.: 795,856

[22] Filed: Feb. 6, 1997

Related U.S. Application Data

[63] Continuation-in-part of Ser. No. 562,507, Nov. 24, 1995, Pat. No. 5,794,543, which is a continuation-in-part of Ser. No. 523,639, Sep. 5, 1995.

[51] Int. Cl.[6] ..... B65D 19/32

[52] U.S. Cl. ..... 108/56.1; 108/64; 108/57.26; 108/57.33

[58] Field of Search ..... 108/51.11, 902, 108/56.1, 56.3, 901, 64, 57.25, 57.26, 57.33; 403/331, 340

[56] References Cited

U.S. PATENT DOCUMENTS

| | | | |
|---|---|---|---|
| 3,307,504 | 3/1967 | Cloyd et al. | 108/902 X |
| 3,857,342 | 12/1974 | Johns | 108/56.1 X |
| 4,051,787 | 10/1977 | Nishitani et al. | 108/901 X |
| 4,128,253 | 12/1978 | Powers | 108/56.1 X |
| 4,604,014 | 8/1986 | Frano | 108/56.3 X |
| 5,094,175 | 3/1992 | Christie | 108/56.1 |
| 5,388,533 | 2/1995 | Pigott et al. | 108/56.3 |
| 5,483,899 | 1/1996 | Christie | 108/56.3 |
| 5,492,069 | 2/1996 | Alexander et al. | 108/53.3 X |

*Primary Examiner*—Peter M. Cuomo
*Assistant Examiner*—Janet M. Wilkens
*Attorney, Agent, or Firm*—McHale & Slavin, P.A.

[57] ABSTRACT

An interlocking modular pallet apparatus and method of construction and de-construction which includes plastic modular components aligned in a two-by-two arrangement with interlocking male and female tabs which connect in a vertically sliding manner to form an upper support structure with a series of upper apertures through the platform surface. A set of rail components are interconnected in a perpendicular manner to form an evenly spaced grid with corresponding lower apertures. Hollow formed spacing members are placed between each aligned aperture pair. A first interlocking insert is placed through each upper aperture and a second interlocking insert is placed through each lower aperture. The first and second inserts interlock to join the upper support structure with the lower rail assembly, with the spacing members forming cavities for insertion of lifting device appendages. The completed pallet device also includes frictional pads attached across its surface to prevent loads from sliding off.

12 Claims, 9 Drawing Sheets

MODULAR PALLET WITH INTERLOCKING INSERTS

This is a continuation-in-part of application Ser. No. 08/562,507, filed Nov. 24, 1995 which is a continuation-in-part of application Ser. No. 08/523,639, filed Sep. 5, 1995. Application Ser. No. 08/562,507 is now U.S. Pat. No. 5,749,543 and application Ser. No. 08/523,639 is currently pending.

FIELD OF INVENTION

This invention is related to pallet construction, and in particular, to a modular pallet having components which are locked together with interlocking tabs and interlocking insert ties placed between the modular parts.

BACKGROUND OF THE INVENTION

The general utility of pallets is well known for their use as a loading platform for storage and movement of products in quantity. Pallets provide a stable base for a manufacturer or distributor of a product to stack items thereon allowing for ease of movement by use of a forklift or pallet jack. Pallets are constructed from wood, metal, or plastic, and designed to be placed under materials that are to be shipped or stored, providing a clearance underneath for placement of a forklift or pallet jack.

Pallets are reusable requiring that they be durable in construction, lightweight, and stackable. Ideally, the pallet should occupy a minimum amount of space, both vertically and horizontally. The durability of a pallet is dependent on the type of material used for construction. Pallets constructed of wood will provide years of service if not exposed to harsh conditions that could cause rotting, or unusual loading situations which could cause collapse of the wood frame or wood components. Wood pallets are in constant need of repair wherein a damaged pallet slat is replaced with a new slat by either nailing or stapling to the base frame. A additional problem with wooden pallets is that wood is a porous material. When used in the food industry, wood can harbor bacterial growth which may contaminate food products. Relatedly, insects and other pests can burrow into the wood and be transported into and infest a previously uncontaminated storage area. Such pests can continue to reproduce and thrive in the wooden structure of the pallet.

Additionally, the porosity of the wood allows for absorption of water. Should the pallet freeze, it can be easily cracked when loaded, even when supporting lightweight products. Should a pallet absorb water, the weight of the pallet can cause difficulties in moving the pallet, and/or injuries to an individual manually moving the pallet. Moreover, splintering from the wood requires an individual who handles the pallet to wear gloves, and otherwise take precautions to prevent from injuring himself during relocation of the pallet.

Wooden pallets also have a significant disadvantage in that they do not interlock or readily stack. Accordingly, should a number of wooden pallets be placed on top of each other, the possibility exists for the pallets to tip over. The is particularly true when any of the pallets within the stack slips away from a squarely stacked position above the underlying pallet.

An alternative to wooden pallets includes metal pallets, such as those formed by aluminum. Metal pallets are known for their durability under normal circumstances. However, aluminum pallets are expensive to manufacture and once damaged, cannot be readily repaired. Should any interim damage occur, such as breach of a weldment, the pallet could have a catastrophic failure under a loaded condition. This could cause injury to operating personnel or damage to the materials positioned on the pallet.

Yet another material used for the construction of pallets is plastic. Plastic is capable of being sterilized, and is impervious to most environmental conditions. However, a plastic pallet is even more difficult to repair than metal if it is not modularly constructed. Should a portion of the pallet become damaged, the entire pallet is destroyed.

U.S. Pat. No. 5,197,395 ('395) discloses a plastic pallet. However, the top and bottom surfaces of '395 comprise a unitary, and not a modular, structure. Hence if the top or bottom unitary structures are damaged, the entire top or bottom structure, or even the whole pallet, must be replaced. The cost of such replacement makes the use of plastic pallets, as a direct replacement for wood pallets, cost prohibitive.

Moreover, despite their superior strength over wood pallets, plastic pallets still cannot withstand unusually forceful abuse, such as when a forklift or semi-truck runs over a portion of the pallet. In particular, the '395 patent subjects the internal locking means to load stresses. Such forces may cause the unitary plastic pallet to crack, whereas a wood pallet may only need a section replaced.

U.S. Pat. No. 5,483,899 ('899) discloses a pallet structure wherein the internal locking means are integrally formed with the vertical dimensioning means. As a result, this pallet puts forceful loads directly on the locking means which is likely to cause breakage under stress. Since the locking means is integrally formed with the pallet part, breakage would require replacement of the entire pallet part. Such breakage of the interconnecting means can prove to be extremely dangerous in that the whole pallet my thereby fall apart and spill heavy objects off of the pallet onto nearby persons.

Accordingly, what is lacking in the art is a lightweight, re-usable plastic pallet comprised of component parts that allows for modular construction and related ease of component replacement, and which avoids placing undue load stresses on interconnecting component parts which might fail under such stresses.

SUMMARY OF THE INVENTION

The present invention provides a pallet device comprised of modular components which are interlockably assembled to form a standard-sized pallet structure with a rectangular shape. The components are optimally formed from plastic so that the materials will be impervious to water and/or pestilent creatures and bacteria. The plastic construction also provides lightweight component parts which are relatively strong compared to heavier and more expensive metal parts.

The modular components of the present embodiment include four upper support sections which are relatively square in shape. Each upper support section has a lattice, or grid-like, structure which allows water to flow through the lattice spaces. This lattice structure also allows each upper support section to be relatively lightweight compared to a solidly formed section. The four sections each include two inner facing edges and two outer facing edges. The inner facing edges of each section are adjoined with interlocking tabs to form a complete upper support surface which is approximately square in shape, as per a standardized pallet. Each diagonal upper support section is identically formed and thereby only two molds are required to form the four sectional components.

The modular components used to form the pallet device additional includes a first and second set of rails, with each set including three rail members. Each set of rails includes three apertures along its length which are shaped to receivably accommodate locking inserts. The rail members are assembled into an evenly spaced grid with the first set of rails being oriented perpendicular to the second set of rails. The second set of rails includes three arched, or raised sections, one on each end and one in the middle, which conformably fit over and hold the first set of rails in place. The apertures of the first and second assembled rails align with each other, and the collectively formed apertures of the upper support sections align with the collectively formed apertures of the assembled rails.

The upper support sections each include a number of cutouts or apertures which accommodate a first set of interlocking inserts for fixably joining the upper support sections and lower rail components together. Each outer corner includes a square-shaped aperture which is shaped to accommodate a square-shaped interlocking insert from the first set. The inner faces of each section each include half of a square-shaped aperture along the outer edge. These aperture halves of each support section adjoin with the corresponding aperture halves on the adjoining support sections. The adjoining aperture halves form a complete square-shaped aperture for receiving a square-shaped locking insert. Similarly, the innermost corner of each support section includes a quarter of a square-shaped aperture which forms a complete square-shaped aperture in the center of the upper structure when the four support sections are adjoined. The apertures of the upper support section align with corresponding apertures formed by the lower rails.

Spacing members consisting of blocks and other relatedly shaped members are placed between the upper support structure and the assembled rail sets. The block members are pipe-like, or hollow, and allow passage of objects through their middle section. The first and second locking inserts each include prongs with hooking elements or tabs which extend from a relatively flat surface of the locking insert. The prongs of each first locking insert are oriented to lockably interact with the prongs of each second locking insert. Accordingly, the set of first locking inserts are placed through the top into the apertures of the upper support structure and the set of second locking inserts are placed through the bottom into the apertures of the assembled rails sets. The prongs of the first and second locking inserts meet between the spacing members and the prongs interlock, thereby joining the upper and lower pallet components together.

Additional features include frictional bordering surfaces distributed over and attached to the upper surface of the support structure. These bordering surfaces are typically made from rubber and prevent objects which are loaded onto the pallet from slipping off the side. Similar rubber surfaces are included on the lower surface of the support structure to prevent slippage of the assembled pallet off the tines of forklift or pallet-lift device.

Accordingly, it is an object of the present invention to provide a pallet device comprised of component parts which can be interlockably assembled into a complete standard sized pallet.

It is yet another object of the present invention to provide a pallet device with component parts made from durable, yet relatively lightweight plastic.

It is yet another object of the present invention to provide a pallet device which has an upper support structure comprised of interlockably adjoined sections, and a lower grid assembly, with spacing members interspersed between.

It is still another object of the present invention to provide a pallet device with pronged locking inserts, a first set inserted from above the support structure, and a second set inserted from below the grid assembly, wherein the locking inserts interlock to hold the pallet assembly together.

It is a further object of the present invention to provide a pallet device with a series of aperture holes through the aligned and assembled components for receiving the interlocking inserts.

It is still another object of the present invention to provide a pallet device with non-skid or frictional surfaces on the upper support surface, and on the forklift engaging surfaces, of the assembled pallet device.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
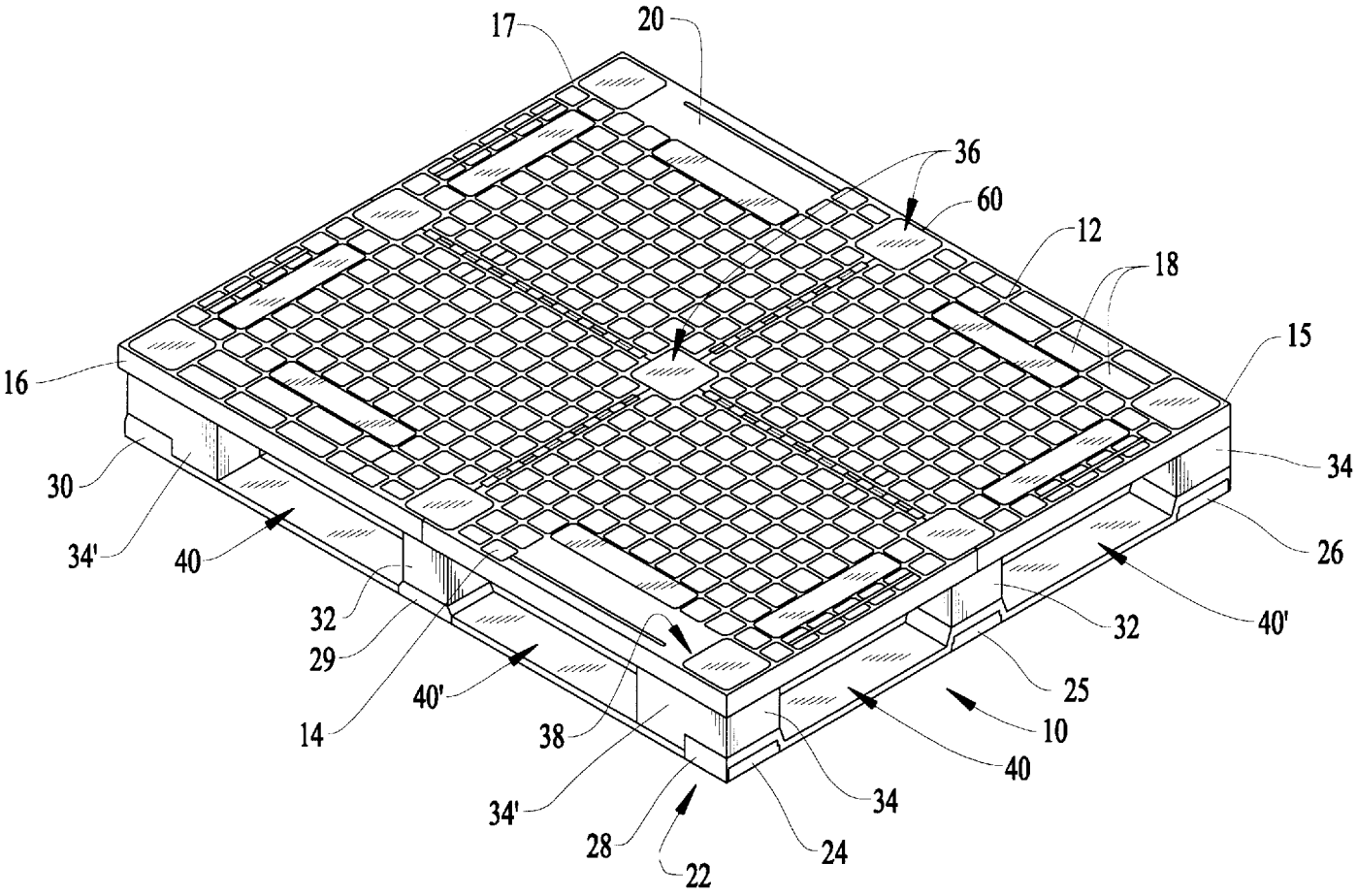
FIG. 1 is a perspective view of the assembled pallet structure.

Referring now to FIG. 1, an assembled pallet structure 10 is shown as composed of the various interlockably joined components parts. The upper support structure 12 is shown comprised of a first, second, third, and fourth upper support section 14, 15, 16, and 17 which are interconnected together along their inner edges via interlocking tabs (See FIG. 18 described below). Each upper support section is grid-like in structure, with a series of square-shaped through holes 18 across its surface. At least two of the upper support sections include a relatively flat area 20 for receiving placement of a label, logo, and/or symbol as desired by the manufacturer or user.

The pallet assembly 10 also includes a rail assembly 22 which is formed by interlocking a first set of rails 24, 25, and 26 in a perpendicular grid-like fashion with a second set of rails 28, 29, and 30. The rail assembly 22 is separated from the upper support structure 12 by a set of spacing members of a first type 32 and a second type 34. The spacing members 32, 34 are pipe-shaped, or hollow the middle, with the second type 34 having an additional appendage 34'. The rail assembly 22 and support structure 12 are then alignably joined together with the spacing members sandwiched in-between. The spacing members 32, 34 are shaped and oriented so that a pair of gaps 40 and 40' are created on each side of the assembled pallet structure to facilitate insertion of the tines of a forklift or pallet lifting device.

A plurality of lockable insert pairs 36, each consisting of a first and second locking insert component (see FIGS. 13 and 21) are shown placed in the assembled pallet structure. The first locking inserts 60 (see FIG. 21) are mountably placed in apertures or cutouts 38 (see FIG. 17) in the upper support structure 12, and the locking inserts extend down through the spacing members 32 and 34. A corresponding second set of locking inserts (not shown in this view) are mountably placed up through a corresponding set of apertures or cutouts in the bottom of the rail assembly 22. A series of interlockable prongs on the first and second corresponding inserts interlock together (See FIG. 23) and thereby hold the upper and lower component parts together.

Figure 2:
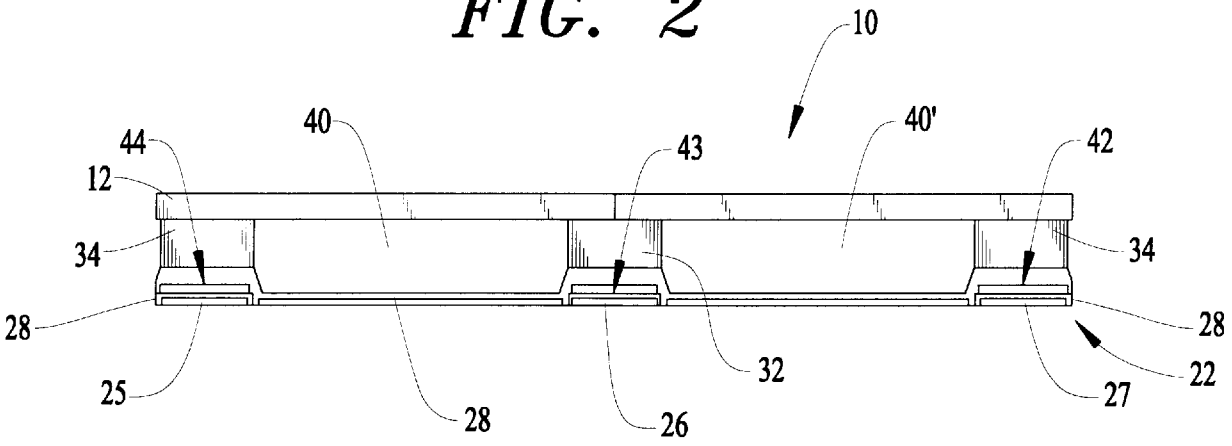
FIG. 2 is a side view of the assembled pallet along the shorter side of the rectangular pallet structure.

Referring also to FIG. 2, a side view of the short side of the assembled rectangle pallet structure 10 is shown. The first set of rails 25, 26, and 27 each lie flat against the ground or other support surface. Rail 28 from the second set of rails is shown along its lengthwise edge and lies perpendicularly across the first set of rails 25, 26, and 27. Each rail from the second set includes three arches or raised sections 42, 43, and 44 which fit over and conformably interlock with the underlying first set of rails. The rails thereby form the rectangular grid assembly 22 which comprises the lower component of the assembled pallet structure 10. The upper support structure 12 is separated from the lower grid assembly 22 by the spacing members 32 and 34. The cavities or gaps 40 and 40' are thereby formed for insertion of a pallet lifting device.

Figure 3:
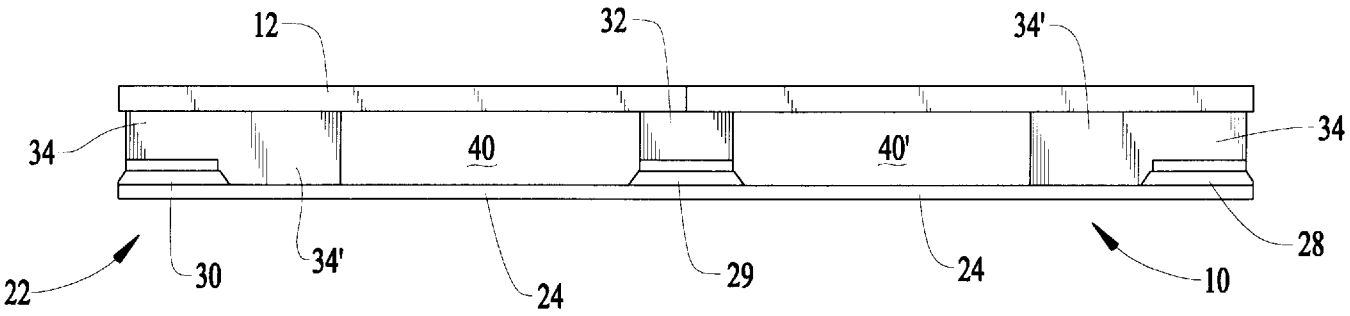
FIG. 3 is a side view of the assembled pallet along the longer side of the rectangular pallet structure.

Referring now to FIG. 3, a side view of the long side of the assembled rectangle pallet structure 10 is shown. Rail 24 from the first set of rails is shown along its lengthwise edge. The ends of rails 28, 29, and 30 are shown interlocked over the top portion of the rail 24. As before, the upper support structure 12 is separated from the lower grid assembly 22 by the spacing members 32 and 34, and the gaps 40 and 40' are formed for insertion of a pallet lifting device.

Figure 4:
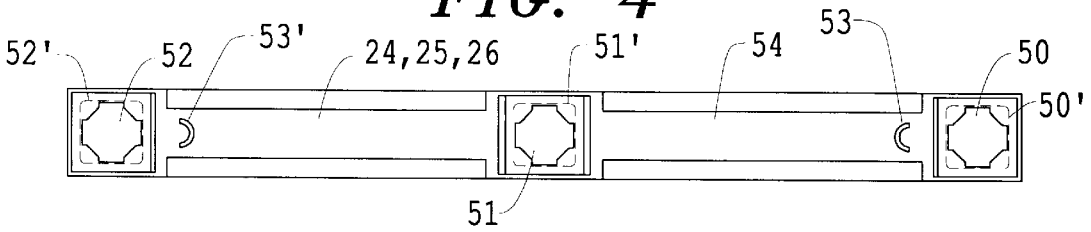
FIG. 4 is a top view of a rail component from the first set.
Figure 5:
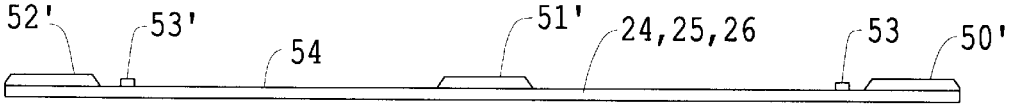
FIG. 5 is a side view of the rail component of FIG. 4.
Figure 8:
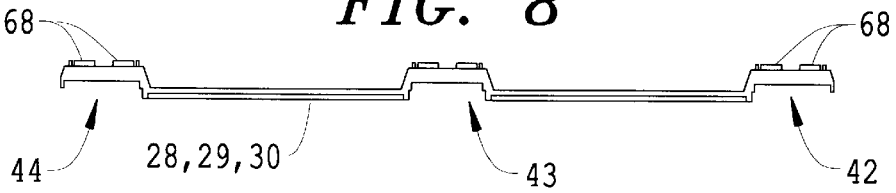
FIG. 8 is a side view of the rail component of FIG. 7.

Referring now to FIG. 4, a top view of an identically formed rail 24, 25, and 26 from the first set of rails is shown. Referring also to FIG. 5, the rails 24–26 are shown to lie flat against the ground. Each rail includes three apertures or cutouts 50, 51, and 52 which extend through the rail to accommodate a locking insert. Each aperture 50–52 has a square shaped lip or extension 50', 51', and 52' associated with the upper surface 54 that fits inside the cavities 42–44 formed in the second set of rails (See FIG. 8). An additional lip 53 and 53' extends from the upper surface 54 and fits inside the inner surface of appendage 34' in the spacing member 34 (See FIGS. 1 and 16).

Figure 6:
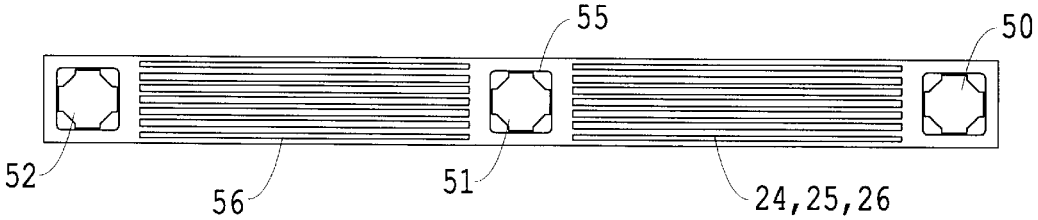
FIG. 6 is a bottom view of the rail component of FIG. 4.

Referring now to FIG. 6, the bottom surface 55 of the rails 24, 25, 26 are shown to include a non-slip surface 56. This surface 56 might consisting of rubberized additions to the rail, and/or projections formed along the length of the rail surface 56. The bottom view of the rail shows the apertures 50, 51, and 52 which are formed to receive a square-shaped locking insert 60' (see FIG. 13) from a second set of inserts. Each aperture 50–52 is shaped to receivably accommodate the pronged sections extending out from the locking insert 60' (See FIG. 13).

Figure 7:
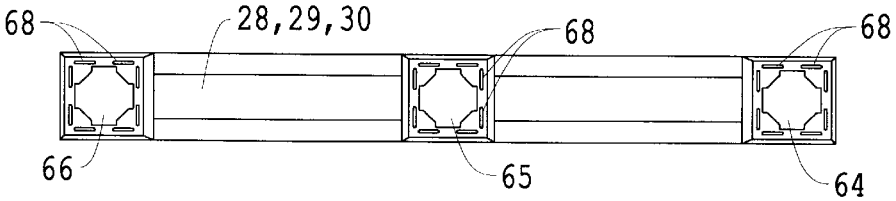
FIG. 7 is a top view of the a rail component from the second set.
Figure 9:
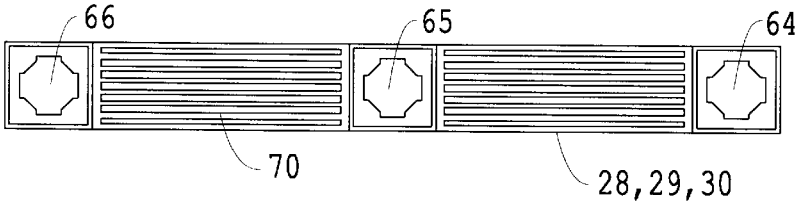
FIG. 9 is a bottom view of the rail component of FIG. 7.

Referring also to FIG. 7, a top view of an identically formed rail 28, 29, and 30 from the second set of rails is shown. Each rail includes three apertures 64, 65, and 66 which align with the various apertures 50, 51, and 52 on the first set of rails 24–26. Apertures 64–66 are similar in shape to apertures 50–52. The second set of rails 28–30 also includes arched sections 42, 43, and 44 which conformably fit over the first set of rails 24–26 when the rails are assembled into a grid. The rails 28–30 additionally include a plurality of tabs, in this embodiment eight tabs per aperture 68, which are distributed around each aperture 64–66. Tabs 68 extend upwards in a square-shaped pattern and fit inside the spacing members 32 and 34 which are placed over the aperture tabs 68. Tabs 68 serve to center, align and hold in place the spacing members 32 and 34 when assembling the components of the pallet assembly. Referring also to FIG. 9, the bottom view of the rails 28–30 show a non-slip surface 70 as similar to that shown in FIG. 6. The apertures 64–66 are similarly shaped to accommodate insertion of the locking insert 60' (See FIG. 13) from the second set of inserts.

Figure 10:
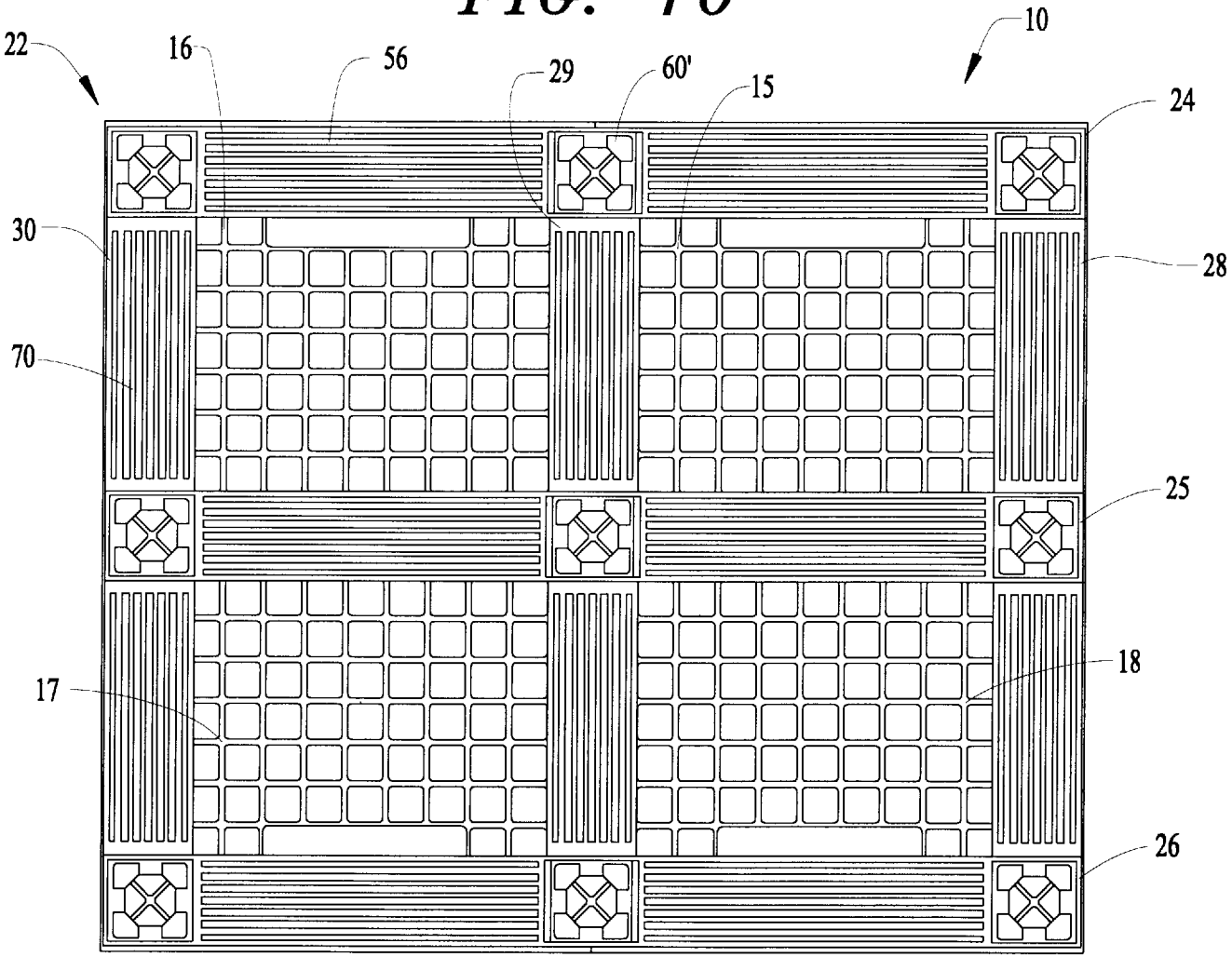
FIG. 10 is a bottom view of the assembled pallet structure.

Referring now to FIG. 10, a bottom view of the assembled pallet structure 10 is shown. The grid assembly 22 is shown comprised of the first set of rails 24–26 which are perpendicularly interlocked with the second set of rails 28–30. The upper support sections 15–18 can be seen through the grid 22. Each aperture in the grid 22 receives a locking insert 60' from the second set of inserts, with the interlocking prongs inserted inward (See FIG. 23), and the locking insert 60' mounting flush against the bottom surfaces of the rails 24–26 and 28–30. The non-slip surfaces 56 and 70 extend across the entire bottom of the grid assembly 22 to prevent slippage of the pallet along a resting surface.

Figure 11:
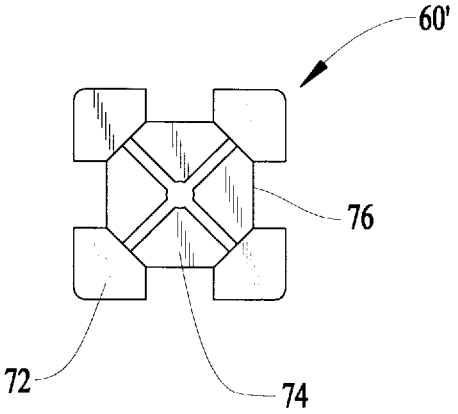
FIG. 11 is a bottom view of a locking insert from the first set of locking inserts.
Figure 12:
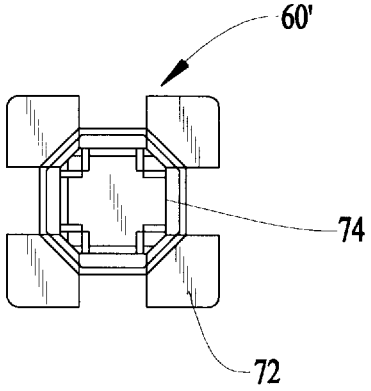
FIG. 12 is a top view of the locking insert of FIG. 11.
Figure 13:
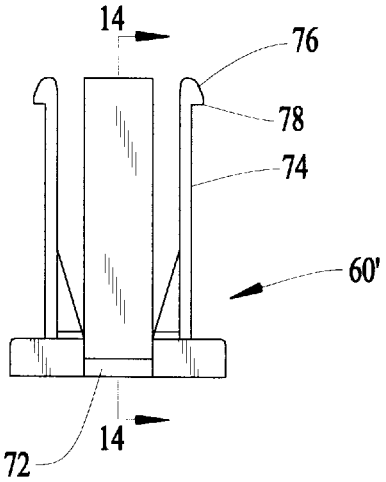
FIG. 13 is a side view of the locking insert of FIG. 11.
Figure 14:
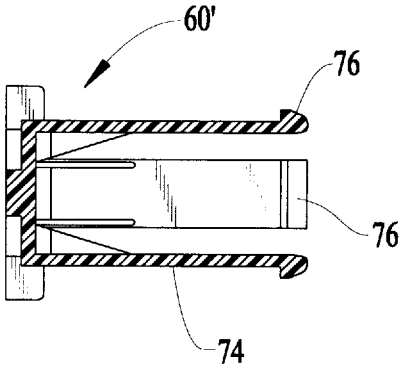
FIG. 14 is a cross-sectional side view of the locking insert of FIG. 13 along cut 14—14.

Referring now to FIGS. 11–14, various views are shown of the locking insert 60', which is part of the second set of locking inserts. FIG. 11 is a bottom view and FIG. 12 is a top view. FIG. 13 shows a side view and FIG. 14 is a cross sectional view of FIG. 13 along cut 14—14. The insert 60' includes a platform 72 which has four arms or prongs 74 extending therefrom. Each prong 74 includes a hooked or barbed-shaped end 76, with the hook surface 78 oriented or pointed outward.

Figure 15:
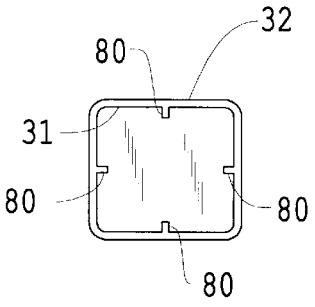
FIG. 15 is a top view of a spacing member.
Figure 16:
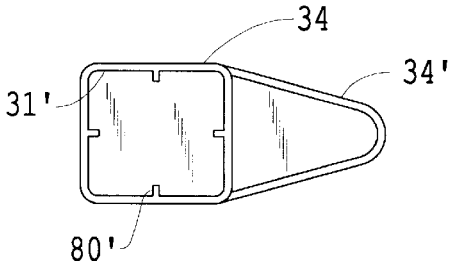
FIG. 16 is a top view of yet another spacing member.

Referring now to FIGS. 15 and 16, a top view of the spacing members 32 and 34 are shown. The inner surfaces 31 and 31' include a series of four tabs 80 and 80' which interlockably fit in-between the elevated tabs 68 on the rail sections 28–30 shown in FIGS. 7–8. In FIG. 16, spacing member 34 includes the appendage section 34'. Spacing member 34 is used on each corner of the pallet assembly and the appendage sections 34' provide extra lateral support extending inward from the corners along the longer side of the rectangular pallet assembly. Appendage 34' extends over and receives the lip extension 53 and 53' as shown on FIGS. 4–5, which provides additional aligned and support for the assembled parts. The spacing members 32 and 34 are hollow or pipe-like to allow passage and interlockability of the prongs of the locking inserts 60 and 60' through the middle of the spacing members.

Figure 17:
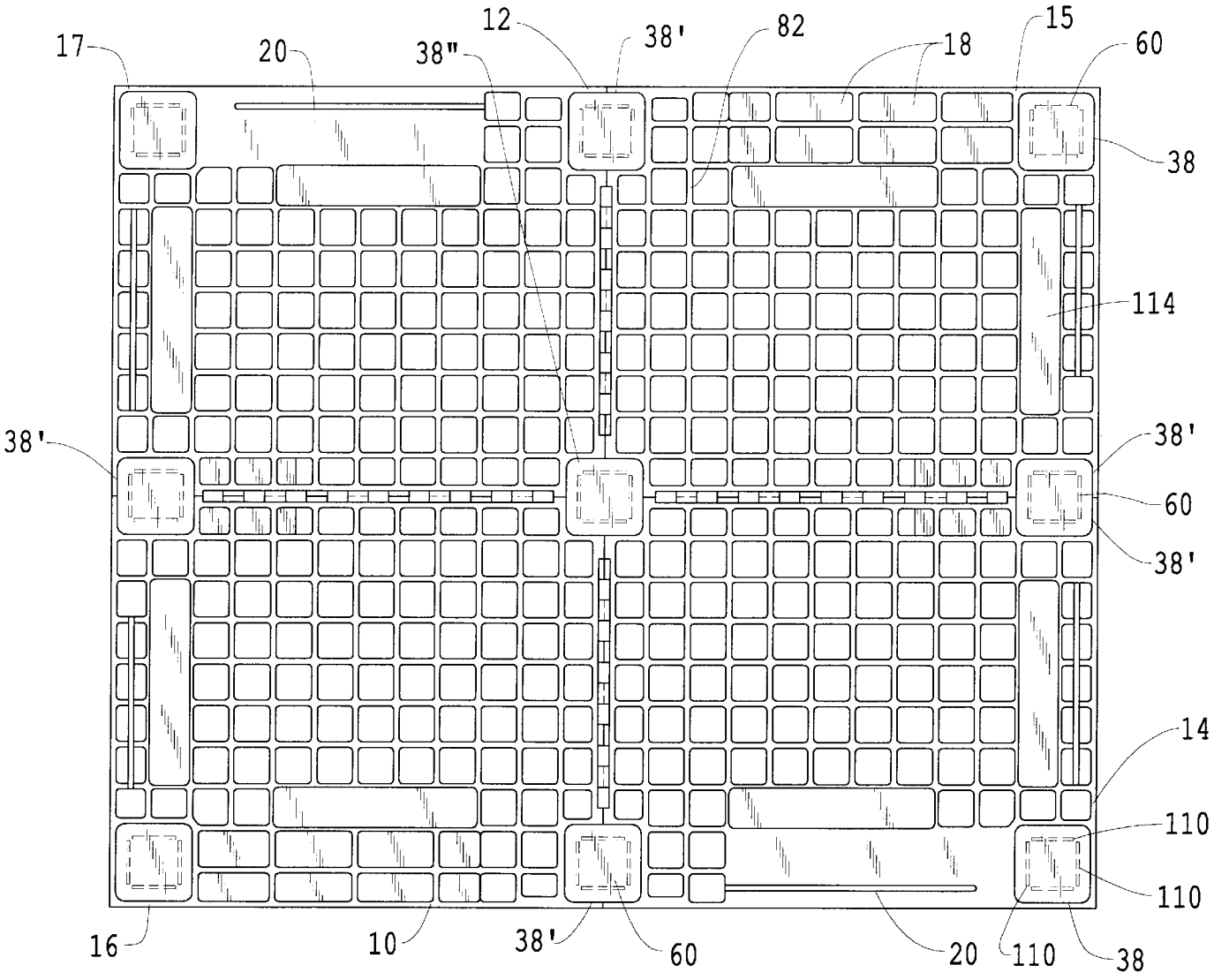
FIG. 17 is a top view of the assembled pallet structure.

Referring now to FIG. 17, a top view is shown of the pallet assembly 10 with the upper support sections 14–17 adjoined along their inner surfaces to form the complete upper support structure 12. Each support section 14–17 includes a lattice of walls 82 which form grid-like through holes 18. The upper support structure 12 includes a collective set of nine apertures 38 which receive the nine locking inserts 60 from the first set of locking inserts. In this embodiment, full apertures 38 are included through each corner of each upper support section 14–17. A series of half-aperture formations 38' are included along the central, outer edge of each upper section 14–17. The half-aperture formations 38' form complete apertures when the upper support sections 14–17 are adjoined. Each upper support section 14–17 also includes a quarter-aperture formation 38" in the center,which forms a complete aperture when the four support sections 14–17 are joined. Upper support sections 14 and 17 are shown to include an surface section 20 which does not have grid formations. This surface section 20 is used to mount a label or logo pertaining to the pallet structure 10.

Figure 18:
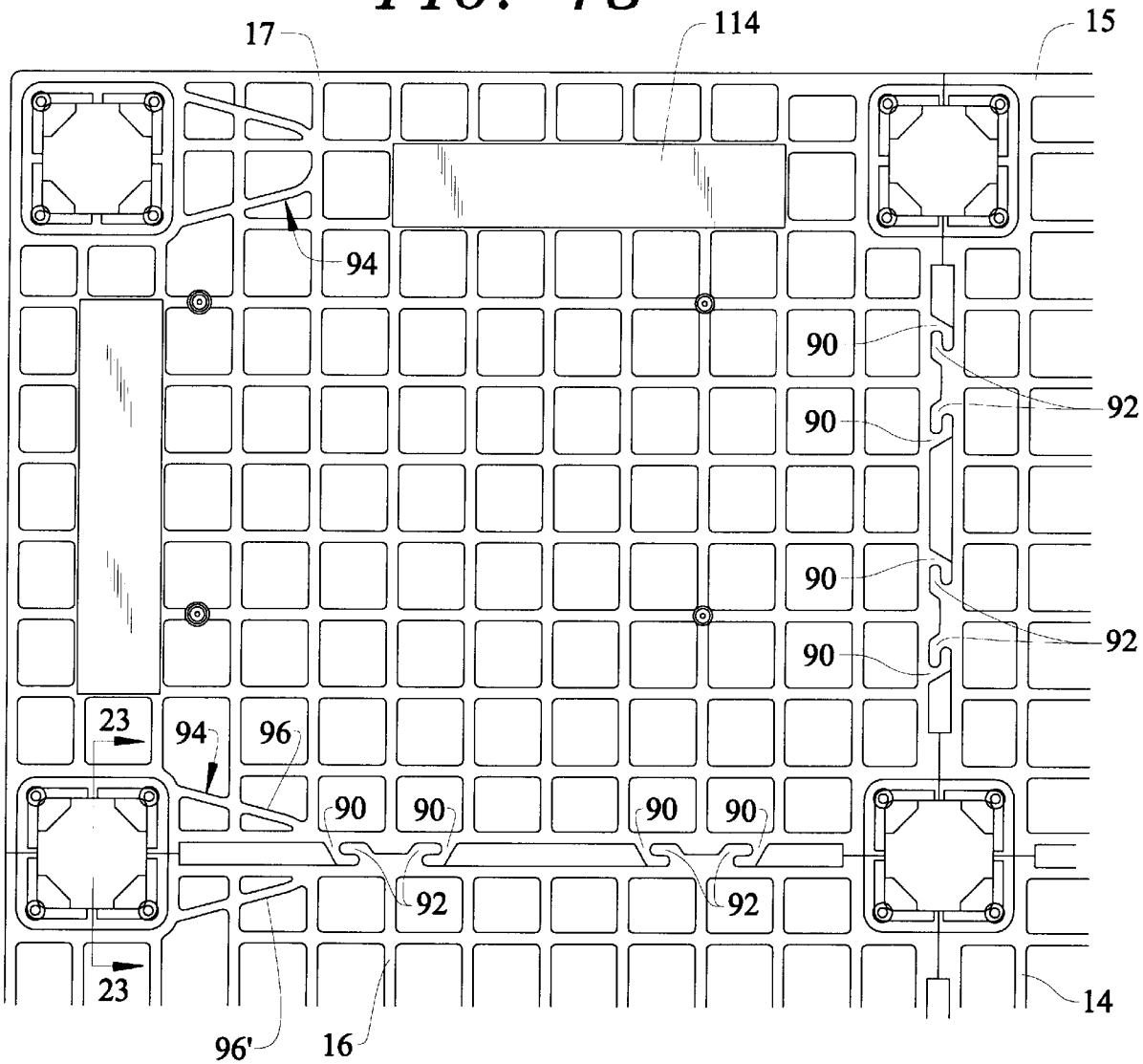
FIG. 18 is a top view of a portion of the assembled pallet structure with interlocking tabs between the upper support sections.

Referring now to FIG. 18, a top view of the upper support section 17 is shown, along with adjoining support sections 14, 15, and 16. As more clearly shown in this view, a pair of female, hook-shaped tabs 90 extend from each inner edge of the upper support section 17. The tabs 90 form a series of receptacles for corresponding male insert tabs or projections 92 extend from upper support sections 15 and 16 and interlock with the female tabs 90. The female and male tabs 90 and 92 are unique in that they interlock together by causing a vertical insertion of the male tabs 92 into the female tabs 90. This is generally done by place a first support section on the ground and orienting the second section over the first section with the female and male tabs aligned. The user then steps forcefully upon the second section so that the tabs are frictionally joined together. The joinder of such tabs as shown provides extreme stability across the horizontal surface of the upper support structure without the sections separating or spreading apart.

Each support section might alternatively include any number of interlocking tabs other than the pairs presently shown on each inner surface. The number of interlocking tabs will varying according the particular purpose of the pallet and the amount of stability and strength needed, as well as the type of plastic material used to form the section parts. Upper support sections 14 and 17 are identically formed parts, as are upper support sections 15 and 16. This allows the use of only two separate molds in order to form all four upper support sections 14–17 of the pallet structure.

Also shown in FIG. 18 are fixtures 94 forming part of the grid structure of each upper support section 14–17. Fixtures 94 also form a mounting surface on the lower facing side of each upper support section 14–17 for receiving and holding into place appendage 34' located on the spacing member 34. Upper support sections 16 and 17 show a first and second half 96 and 96' coming together to form a complete fixture 94.

Figure 19:
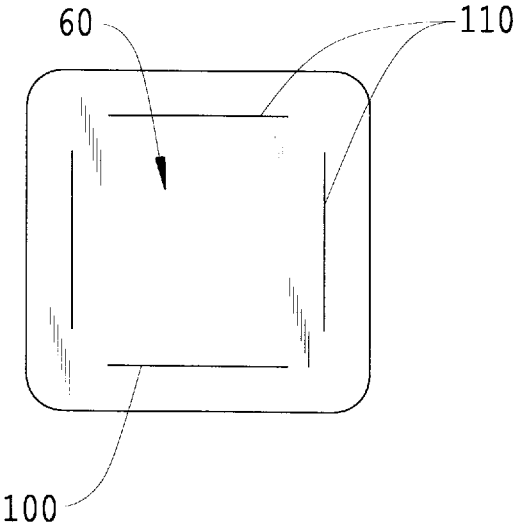
FIG. 19 is a top view of a locking insert from the second set of locking inserts.
Figure 20:
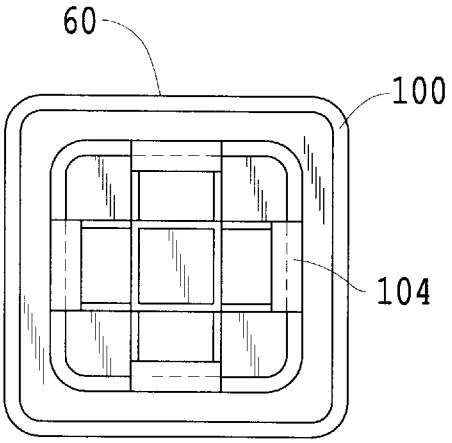
FIG. 20 is a bottom view of the locking insert of FIG. 19.
Figure 21:
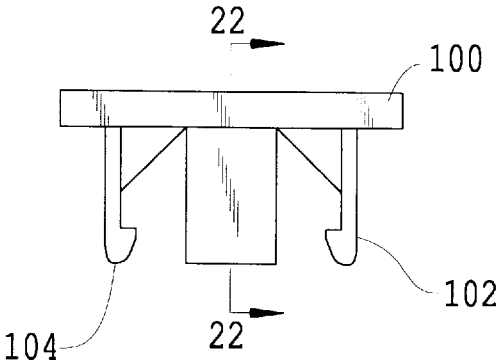
FIG. 21 is a side view of the locking insert of FIG. 19.
Figure 22:
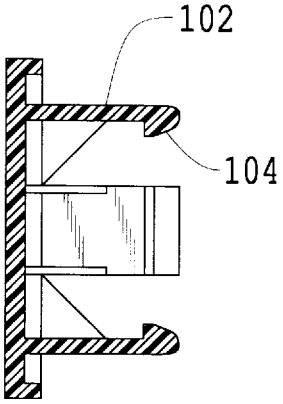
FIG. 22 is a cross-sectional side view of the locking insert of FIG. 21 along cut 22—22.

Referring now to FIGS. 19–22, various views are shown of the locking insert 60, which is part of the first set of locking inserts. FIG. 19 is a top view and FIG. 20 is a bottom view. FIG. 21 is a side view and FIG. 22 shows a cross-sectional view of FIG. 21 along cut 22—22. The insert 60 includes a platform 100 which has four arms or prongs 102 extending therefrom. Each prong 102 includes a hooked or barbed-shaped end 104, with the hooked surface 104 oriented or pointed outward.

Figure 23:
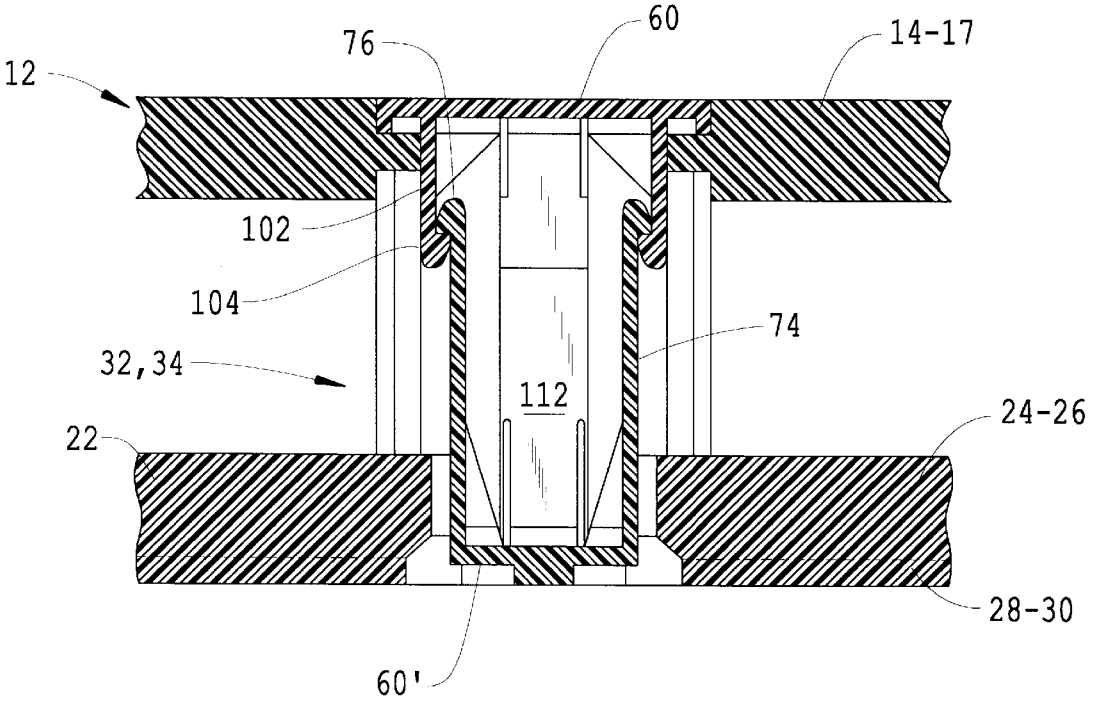
FIG. 23 is a cross-sectional side view of a portion of FIG. 18 along cut 23—23.

Referring now to FIG. 23, a cross-section of the interlocking inserts of FIG. 18 along cut 23—23 are shown. The upper support sections 14–17 are interlockably joined together into the support structure 12 into as detailed above in FIG. 18. The rails 24–26 and 28–30 are assembled into a grid assembly 22. A spacing member 32, 34 is shown between the support structure 12 and assembly 22. The first insert 60 is shown inserted through an aperture in the upper support structure 12, with the second insert 60' shown inserted through an aperture in the grid assembly 22. The prongs 100 and hooked appendages 102 on the first insert 60 interlock with the corresponding prongs 74 and hooked appendages 76 on the second insert 60'.

Figure 23A:
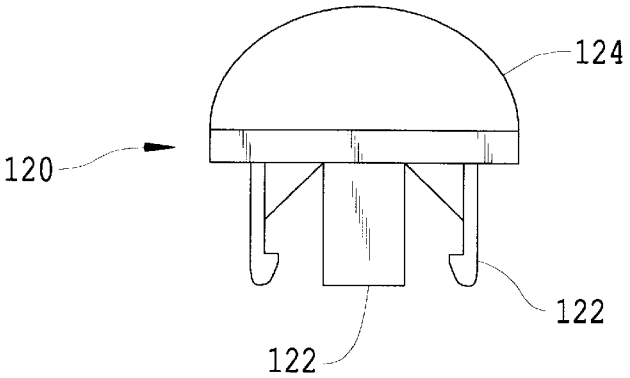
FIG. 23A shows an example disengagement tool.

When the appendages 76 and 102 lock together, they cannot be separated until a specialized tool is inserted into the slots 110 to pry apart the springing engagement of the prongs 74 and 102. Referring now to FIG. 23A, an example tool 120 is shown which consists of extensions or prongs 122 of metal or plastic which penetrate the interior 112 of the joined pallet components, shown in FIG. 23, by insertion through the slots 110 in the platform 100 of the first interlocking insert 60 (See FIGS. 19–21). The tool 120 also includes a handle 124 for grasping and using the device. The tool will have a number of prongs corresponding to the number of prongs on the inserts. Accordingly, the tool is inserted and simultaneously pries back and frees the four prongs extending from either the upper or lower interlocking insert 60, 60'. The tool 120 might take on many other forms and yet still accomplish the same functional disengagement purpose.

The first interlocking insert 60 which is inserted from the top generally has shorter prongs than the second interlocking insert which is inserted from the bottom. This arrangement provides easier access from the top to the interlocked prongs of the inserts so that the tool 120 can be made more compact with shorter prongs 122.

Referring again to FIGS. 17 and 18, a frictional border 114 is placed around the periphery of the upper surface of the support structure 12. The border is comprised of rubberized inserts or pads which are spaced to span several squares of the grid-like structure of each upper support section 14–17. Such rubberized inserts provide a frictional barrier which prevents loaded items from slipping off the top surface of the pallet assembly 10.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and descriptions.

What is claimed is:

1. A pallet device formed from modular components comprising:

an upper support structure formed by interlockably joining a plurality of upper support sections, each section having a platform area with a plurality of upper apertures, and inner side surfaces with a plurality of vertically interlocking tabs between said adjoining upper support sections, said vertically interlocking tabs formed from female tab receptacles on one of said upper support sections and male hook-shaped tab projections on a second of said upper support sections allowing adjacent upper support sections to be selectively joined together;

a lower rail assembly with a plurality of lower apertures corresponding to said upper apertures;

a plurality of spacing members which fit between said upper support structure and said lower rail assembly;

a plurality of first interlocking inserts which fit into said upper apertures and corresponding second interlocking inserts which fit into said lower apertures, said first and second interlocking inserts each including a platform with at least two prongs extending therefrom with hook-shaped flanges, said platform of each said first interlocking insert includes through holes for insertion of a disengagement device for disengaging said first and second interlocking inserts;

wherein said upper support structure and lower rail assembly are spaced apart by said spacing members and held together by interlocking each said first insert with each said corresponding second insert placed through said upper and lower apertures.

2. The pallet device of claim 1, wherein said modular components are made from plastic.

3. The pallet device of claim 1, wherein said upper support structure is formed from four upper support sections interlockable joined in a two-by-two arrangement.

4. The pallet device of claim 1, wherein said lower rail assembly includes a first set of three identically formed rails and a second set three identically formed rails, said first set arranged perpendicularly to said second set to form an evenly spaced grid.

5. The pallet device of claim 4, wherein said second set of rails includes arched sections which conformably fit over said first set of rails to form said grid.

6. A method of construction of said pallet device of claim 5, comprising the steps of:

aligning said upper support sections along said tabbed side surfaces and slidably interlocking said sections with a vertical motion of said male tabs into said female tab receptacles to form the upper support structure;

evenly arranging said first set of rails and perpendicularly arranging said second set of rails to conformably encompass said first set of rails and form said lower rail assembly;

aligning said upper apertures of said upper support structure with said lower apertures of said lower rail assembly;

placing said spacing members between said upper support structure and said lower rail assembly;

placing one of said first interlocking inserts through each of said upper apertures and placing one of said second interlocking inserts through each of said lower apertures and coupling corresponding pairs of said first and second inserts to thereby join said upper support structure to said lower rail assembly.

7. The pallet device of claim 1, wherein a first and second pair of upper support sections are identically formed and interchangable.

8. The pallet device of claim 1, wherein said spacing members are hollow in form and are placed to encompassed said upper and lower apertures.

9. The pallet device of claim 1, wherein said platform area of each said upper support section is comprised of a lattice structure of through holes.

10. The pallet device of claim 9, wherein said upper support structure further includes a frictional border thereon comprised of pads which are located on each of said upper support sections.

11. The pallet device of claim 10, wherein said pads are made from a rubberized material.

12. A method of de-constructing said pallet device of claim 1, comprising the steps of:

inserting a disengagement tool into said through holes of one of said first insert;

forcing said disengagement tool downward to pry apart said prongs of said one insert and is interlocking second insert;

dislodging said one insert to prevent re-engagement of said one first insert and its second insert when said disengagement tool is removed;

disengaging and removing all said interlocking first and second inserts to separate said upper support structure from said lower rail assembly.

* * * * *